US006416049B1

(12) United States Patent
Mitzel

(10) Patent No.: US 6,416,049 B1
(45) Date of Patent: Jul. 9, 2002

(54) SINGLING APPARATUS FOR FLAT SHEET MATERIAL

(75) Inventor: Wilhelm Mitzel, Grasbrunn (DE)

(73) Assignee: Giesecke & Devrient GmbH, Munich (DE)

( * ) Notice: Subject to any disclaimer, the term of this patent is extended or adjusted under 35 U.S.C. 154(b) by 0 days.

(21) Appl. No.: 09/696,218

(22) Filed: Oct. 26, 2000

(30) Foreign Application Priority Data

Oct. 26, 1999 (DE) ..... 199 53 968

(51) Int. Cl.[7] ..... B65H 3/12
(52) U.S. Cl. ..... 271/96; 271/94; 271/108
(58) Field of Search ..... 271/94, 96, 108, 271/196, 276, 112

(56) References Cited

U.S. PATENT DOCUMENTS 3,025,052 A * 3/1962 Guttelitg ..... 271/94
4,269,405 A * 5/1981 Mitzel ..... 271/94
4,591,142 A 5/1986 Divoux et al.
5,088,717 A * 2/1992 Hamataka et al. ..... 271/108
5,499,423 A * 3/1996 Joo et al. ..... 15/319
6,006,712 A * 12/1999 Suzuki ..... 123/184.57
6,095,513 A * 8/2000 Wright et al. ..... 271/94

FOREIGN PATENT DOCUMENTS

| | | | |
|---|---|---|---|
| DE | 44 30 296 | 2/1996 | |
| FR | 2 657 856 | 8/1991 | |
| JP | 57184054 | 11/1982 | |
| JP | 0243432 | * 9/1990 | ..... 271/94 |

* cited by examiner

*Primary Examiner*—H. Grant Skaggs
(74) *Attorney, Agent, or Firm*—Bacon & Thomas, PLLC

(57) ABSTRACT

The present invention relates to an apparatus for singling flat material to be conveyed having a suction device, with openings in the suction device defining an area within which the suction device grasps the material to be singled.

Known singling devices have in particular the disadvantage that operation of the suction device produces a high noise level which is felt to be very unpleasant.

The present invention provides a shifted arrangement of the suction openings which leads at least to partial elimination of the noise during shifted activation of the suction openings.

11 Claims, 2 Drawing Sheets

SINGLING APPARATUS FOR FLAT SHEET MATERIAL

BACKGROUND OF THE INVENTION

The present invention relates to an apparatus for singling flat material to be conveyed having a suction device, with apertures or openings in the suction device defining an area within which the suction device grasps the material to be singled.

Devices for singling flat material to be conveyed having a suction drum as a suction device, as known e.g. from DE 29 05 278 C3, consist substantially of a stator and rotor. The stator has sectorial suction chambers extending in the circumferential direction which are subjected to underpressure. The rotor has suction openings which are each associated with the suction chambers of the stator and remove the material singly from a stack and feed it to a following transport system. The material to be singled is grasped within a rotation angle of the rotating rotor within which the suction chambers of the stator are congruent with the associated suction openings of the rotor, i.e. stator and rotor work on the so-called rotary valve principle. The suction openings of the rotor are usually located along a surface line of the rotor and activated or opened simultaneously. The suction openings can also be slightly shifted from the surface line so as to be opened successively with a small time delay during rotation of the rotor, thereby preventing the material to be singled from being set on a slant. It is likewise known to dispose a plurality of suction openings one behind the other in the sectorial direction which are activated successively during rotation of the rotor so that a plurality of suction openings of the rotor in the sectorial direction are simultaneously active as long as they are in the area of the suction chambers of the stator.

Flat material to be conveyed refers in particular to bank notes, vouchers, data carriers and sheets of paper.

However, known singling devices have in particular the disadvantage that operation of the suction device produces a high noise level which is perceived as very unpleasant. The noise produced by the suction device is caused mainly by the activation of the suction openings. Further noise components result from the material to be conveyed hitting or slapping against the suction device when said material is removed from the stack for singling.

SUMMARY OF THE INVENTION

The present invention is therefore to state an apparatus for singling flat material to be conveyed having a suction device wherein at least the noise produced by the suction openings during operation is lowered so that the resultant noise level is reduced.

The problem is solved according to the novel features of the invention.

The invention includes a suction device having a plurality of openings formed along the periphery of the rotor such that the openings are arranged in rows in an alternating, staggered relationship to thereby generate an inverse pressure profile between alternating rows and a time shifted activation of the openings to partially eliminate noise produced from activation of the openings.

Further advantages of the present invention result from the dependent claims and the following description of embodiments with reference to figures. The figures show only the components relevant for understanding the present invention. The same components in different figures have the same reference signs.

DETAILED DESCRIPTION OF THE PREFERRED EMBODIMENTS OF THE INVENTION

Figure 1:
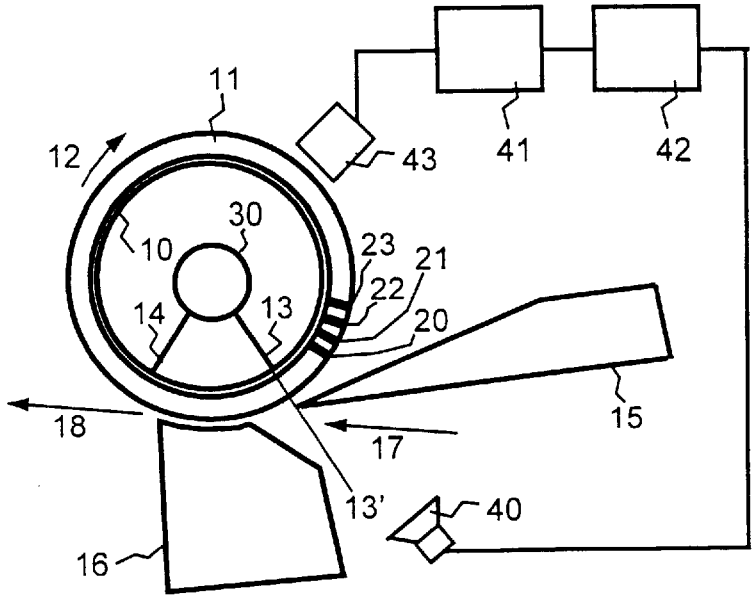
FIG. 1 shows an embodiment of an apparatus for singling flat material to be conveyed having a suction drum, in a simplified schematic representation.

FIG. 1 shows an apparatus for singling flat material to be conveyed having a suction drum in a simplified schematic representation. The suction drum is formed by stator 10 and rotor 11. Guiding device 15 and retaining device 16 are also present. A stack of material to be conveyed (not shown) is laid against guiding device 15 and the material singled by means of the suction drum, transported in the direction indicated by arrow 17 and passed on to a transport device (not shown) which transports the singled material for further processing in the direction indicated by arrow 18. Retaining device 16 serves to avoid double picks or unintentional picks of material from the stack.

Stator 10 has opening 30 via which stator 10 can be connected to an underpressure system. Moreover, stator 10 has a suction chamber delimited by opening edge 13 and closing edge 14. To illustrate the structure of stator 10, it is shown again in FIGS. 2*a*) and *c*), in a top view of the suction chamber and as a cross section.

Figure 3:
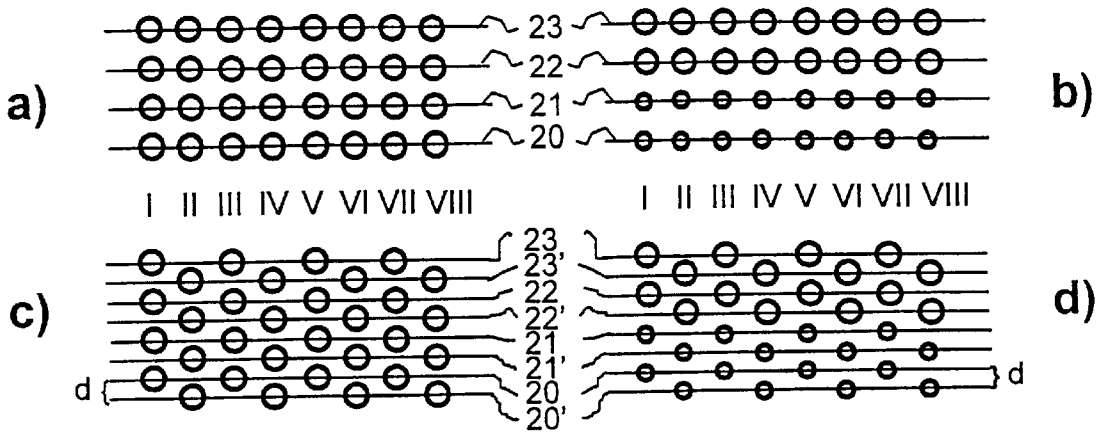
FIG. 3 shows four embodiments of suction openings for a rotor for the suction drum of the apparatus for singling flat material to be conveyed, in a simplified schematic representation.

Rotor 11 having a first set of rows of apertures or suction openings along surface lines 20, 21, 22, 23 rotates in the direction indicated by arrow 12. For illustration, the suction openings along surface lines 20, 21, 22, 23 of rotor 11 are shown in a top view of the suction openings in FIG. 3*a*). As soon as the suction openings of a surface line 20, 21, 22, 23 have passed opening edge 13 of stator 10, the suction openings are opened or activated since they are in communication with the suction chamber of stator 10 to the underpressure produced by the underpressure system; the material to be singled is grasped and singled by the suction drum.

The hitherto described mode of functioning of the apparatus for singling flat sheet material is known in the art and described more closely for example in the abovementioned DE 29 05 278 C3.

Figure 4:
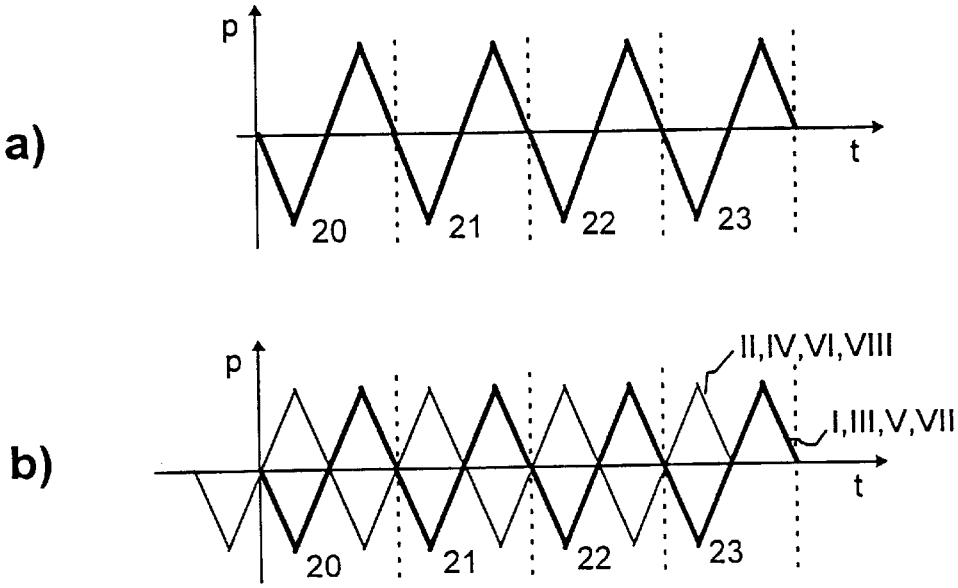
FIG. 4 shows the schematic pressure relations on the suction drum in the area of grasping of the flat material to be conveyed during operation of the apparatus for singling flat material to be conveyed.

During operation of the apparatus for singling flat material to be conveyed a pressure distribution as shown schematically in FIG. 4*a*) results on the suction drum. Activation of the suction openings along surface lines 20, 21, 22, 23 first causes an underpressure in each case which corresponds to the underpressure produced by the underpressure system. As a physically induced countereffect an opposed overpressure arises which corresponds in amount roughly to the underpressure. The thus produced oscillation quickly drops toward zero. For the suction openings along surface lines 20, 21, 22, 23 the time history of the arising total oscillation as results from rotation of rotor 11 of the suction drum is shown, whereby for simplification only the first full wave consisting of an underpressure and an overpressure half-wave is shown for each row of suction openings along surface lines 20, 21, 22, 23. The shown pressure distribution produces a level of noise which can be felt to be disturbing by an operator.

To reduce the noise level one disposes the suction openings in rotor 11 as shown in FIG. 3*c*). Every second suction opening along surface lines 20, 21, 22, 23 is shifted by distance d over the other suction openings of the particular surface line so that a second row of apertures or the shifted suction openings are likewise located on surface lines 20', 21', 22', 23' shifted by distance d from surface lines 20, 21, 22, 23. Deviating from the shown displacement, a sectorial displacement in the other direction is also possible. It is likewise possible to shift the other suction openings over every second suction opening.

The above-described displacement of every second suction opening by distance d results in a pressure distribution in time on the suction drum as shown schematically in FIG. 4*b*), distance d resulting from the geometric variables of the suction drum, such as circumference of the stator or interior circumference of the rotor, size of the suction openings and in particular the rotating speed of the rotor. At an interior diameter of the rotor or diameter of the stator of 63 mm and a rotating speed of the rotor of 20 rps, one obtains a distance for d of about 2 mm.

For the suction openings remaining on surface lines 20, 21, 22, 23 along sectorial lines I, III, V, VII one obtains a pressure distribution in time which corresponds to that shown in FIG. 4*a*). The suction openings shifted by distance d on surface lines 20', 21', 22', 23' which are disposed along sectorial lines II, IV, VI, VIII result in a pressure distribution which is a half-wave in advance of the pressure distribution of the suction openings along sectorial lines I, III, V, VII. This results in elimination of the pressure waves except for the first, advance underpressure half-wave of the suction openings shifted by distance d on surface line 20' over surface line 20 and the last overpressure half-wave of the suction openings of last surface line 23, resulting in a clear reduction of the noise level.

Figure 2:
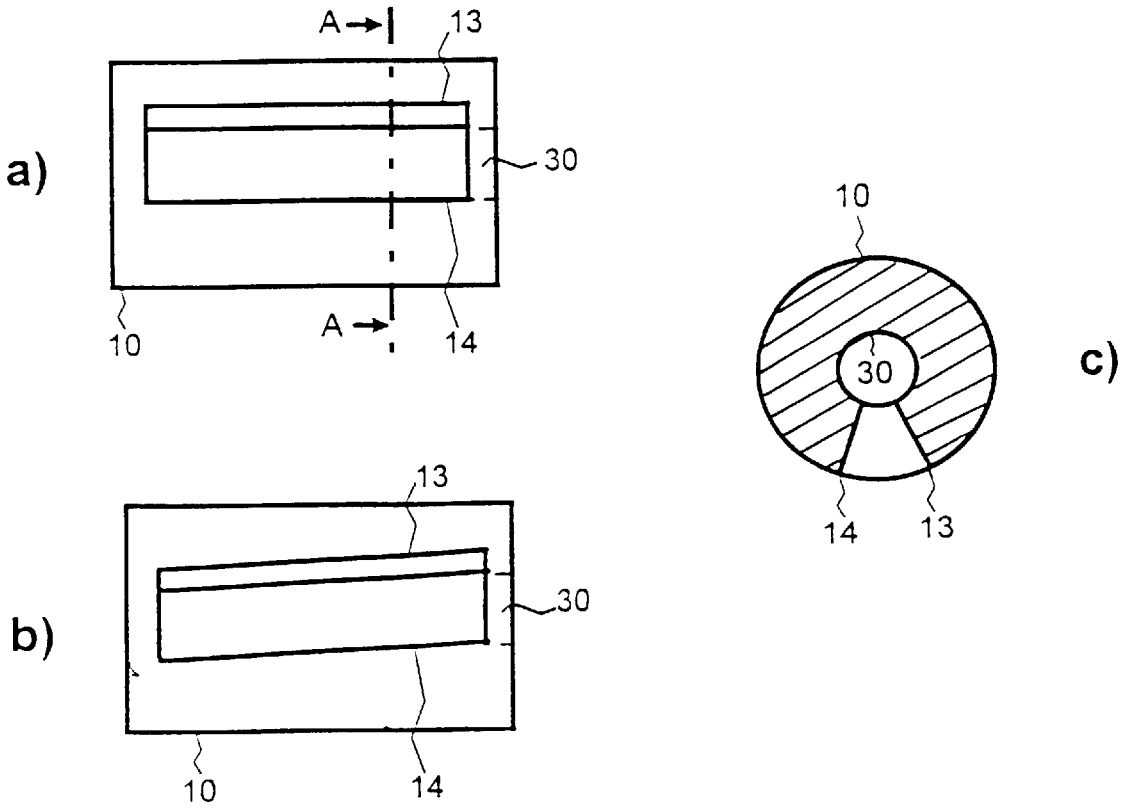
FIG. 2 shows two embodiments of a stator for the suction drum of the apparatus for singling flat material to be conveyed, in a simplified schematic representation.

A further reduction of the noises produced by the suction drum used in the apparatus for singling flat material to be conveyed can be obtained by a time shifted activation of the suction openings of the individual surface lines. One possibility is, as shown in FIG. 2*b*), to dispose opening edge 13 and closing edge 14 of the suction chamber of the stator on a slant, i.e. not along surface lines. During rotation of the rotor the individual suction openings are activated successively along particular surface lines 20, 21, 22, 23 or 20', 21', 22', 23', which spreads the remaining under-pressure and overpressure half-waves apart. This measure furthermore has the advantage of preventing the flat material to be conveyed from being set on a slant when removed from the stack since the material can be directed specifically against a guiding device.

Another possibility of further noise reduction is offered by the use of suction openings varying in size in rotor 11, as shown in FIGS. 3*b*) and *d*). This is obtained for example by reducing the size of the two rows of suction openings activated first (i.e. surface lines 20, 21 or 20', 21') compared to the suction openings along surface lines 22, 23 or 22', 23'. If the suction openings are selected so great that flat material can be drawn off the stack, the material tends to beat against rotor 11, thereby producing a further noise component. Reducing the size of the suction openings first activated makes it possible for the flat material to approach or cling to rotor 11 without any relevant additional noise production. This is also obtained if additional suction openings are disposed before the first suction openings along surface lines 20 or 20'. Said additional suction openings can for example also be smaller or one can provide fewer additional suction openings.

Additional noise reduction is possible if opening edge 13 of stator 10 is adjusted such that activation of the first suction openings of rotor 11 is effected only after the suction openings have passed the front edge of guiding device 15. This can avoid additional swirls produced by the underpressure, thereby obtaining the desired noise reduction. FIG. 1 indicates the necessary position of opening edge 13 by means of auxiliary line 13'.

Figure 5:
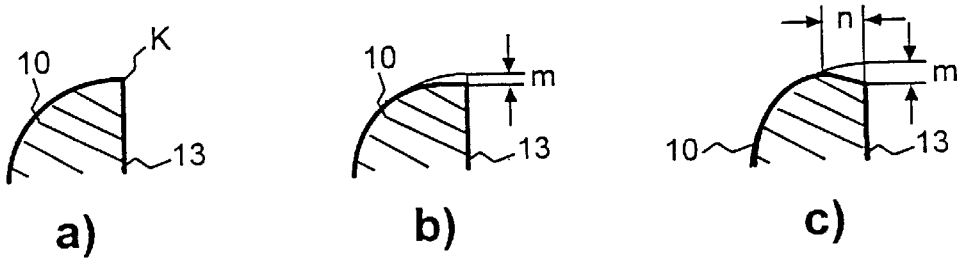
FIG. 5 shows three embodiments of stator edges limiting a suction chamber of the stator.

Further noise reduction is possible by changing in particular opening edge 13 of stator 10. FIG. 5*a*) shows opening edge 13 of stator 10, the place marked by reference sign K being of special interest. By chamfering or breaking edge K one obtains a softer transition of the pressure relations during activation of the suction openings of rotor 11, thereby producing less noise. For this purpose one can create flattening m of edge K perpendicular to opening edge 13 as in FIG. 5*b*), or obliquely with a ratio of m:n as in FIG. 5*c*), whereby a ratio of 1:3 has proven to be especially advantageous.

Besides the embodiment described by way of example, many modifications are conceivable and possible.

For example, it can be provided that the suction openings are not produced singly in rotor 11 itself. Rather, it is possible to produce a gap in the area of the suction openings and provide it for example with a dovetail groove. An accordingly opposed grooved insert with suction openings can then be produced from any material, such as rubber, and incorporated into rotor 11.

It is likewise possible to dispose a plurality of suction chambers in stator 10 or to realize the required shifted activation of the suction openings for example by a shift of the suction chamber or chambers of stator 10. A further possibility involves realizing the required time activation of the suction openings by a shift of both the suction openings and the suction chamber or chambers.

It is obvious that the hitherto described principle of eliminating disturbing noises is also suitable for apparatuses for singling flat material to be conveyed which work with a suction device other than a suction drum, such as a suction band or suction slide. Such suction devices use linear motion instead of rotating motion for singling the flat material to be conveyed. What is decisive for the present motion is the elimination of disturbing noises due to the shifted arrangement of the suction openings as explained in connection with FIGS. 3 and 4. A corresponding shift can thus also be provided for the suction openings of a suction band or suction slide. One can also apply the other measures described for noise reduction, such as the use of suction openings with a smaller diameter, in suction devices working with linear motion.

A further improvement in the reduction of noise during singling can be obtained if one additionally attenuates the production of noise by first and last openings 20' and 23 which cannot be compensated as described above. This can be achieved for example by active sound attenuation. Active sound attenuation refers to the production of opposite-phase sound signals which lead to elimination of the sound signals causing the noise.

In the inventive apparatus a loudspeaker 40 is mounted for this purpose in the vicinity of the place of origin of the noise, for example in the vicinity of auxiliary line 13', for producing a sound signal in phase opposition to the sound signals causing the noise. To permit an opposite-phase sound signal to be produced, the sound signal causing the noise for first and last openings 20' and 23 can be detected by means of a microphone. To obtain the phase opposition, the detected signals are mirrored on the signal axis, i.e. the amplitude values of the signal are provided with a reverse sign. This can take place immediately upon detection of the signal or later during opposite-phase reproduction. A plurality of signals can also be detected and averaged. The electric signals, of the microphone can be digitized and thus determined signal pattern then stored in a memory 41, e.g. an EPROM or EEPROM. The signal stored in the memory can then be read out of the memory and reconverted to an analog signal. The analog signal can be amplified by an amplifier 42 and reproduced by the loudspeaker 40.

For exact synchronization of the reproduction of the opposite-phase signal one can use rotor 11 of the apparatus since it normally has means for determining angular position 43 and thus the position of openings 20' to 23. The output signal of the means for determining angular position 43 is used to control the readout process of the data of the opposite-phase signal stored in the memory.

Tests have shown that the use of opposite-phase signals for active sound attenuation leads to good results in particular with first openings 20'.

What is claimed is:

1. An apparatus for singling a stack of advancing flat material comprising a suction device having a suction area for grasping and singling said flat material, said suction area being defined by a suction chamber of said suction device in communication with a plurality of apertures formed along the periphery of said suction device and arranged in rows such that the apertures of each row are staggered in an alternating relation to the apertures of adjacent rows, wherein a first set of rows of said apertures and a second set of rows of said apertures have mutually offset pressure distributions in respect to one another to thereby generate a time shifted activation of the suction device upon rotation of said suction device and partially eliminate noise produced from activation of said plurality of apertures.

2. The apparatus according to claim 1 wherein the suction device comprises a stator and a rotor which form a suction drum, said stator having first and second edges that delimit said suction chamber, said first and second sets of rows being defined along the periphery of said rotor.

3. The apparatus according to claim 2 wherein the apertures of said second set of rows are shifted a predetermined distance in said staggered relationship to the apertures of said first set of rows according to a predetermined rotational speed of the suction device.

4. The apparatus according to claim 2 wherein said apertures are formed parallel to surface lines of said rotor, and said suction chamber is positioned obliquely to said surface lines of said rotor.

5. The apparatus according to claim 2 wherein at least one of said first and second edges of said stator is chamfered.

6. The apparatus according to claim 1 wherein at least half of said plurality of apertures are activated with a time shift.

7. The apparatus according to claim 1 wherein at least one row of each of said first and second rows have apertures of a smaller size than apertures of other rows of a respective one of said first and second sets of rows, said rows having smaller apertures being activated before said other rows.

8. The apparatus according to claim 1 wherein each of said rows is individually and successively activated.

9. The apparatus according to claim 1 further comprising an active sound attenuation device.

10. The apparatus according to claim 9 wherein the active sound attenuation device produces a sound signal having an opposite phase course to a sound signal generated by a first row of said second set of rows.

11. The apparatus according to claim 9 wherein the active sound attenuation device produces a sound signal having an opposite-phase course to a sound generated by a last row of said first set of rows.

* * * * *